US005219092A

United States Patent [19]

Morand

[11] Patent Number: 5,219,092

[45] Date of Patent: Jun. 15, 1993

[54] DISPENSER FOR FOLDED PAPER TOWELS

[75] Inventor: Michel Morand, Montreal, Canada

[73] Assignee: Wyant & Company Limited, Lachine, Canada

[21] Appl. No.: 877,759

[22] Filed: May 4, 1992

[30] Foreign Application Priority Data

Feb. 11, 1992 [GB] United Kingdom ..... 9202822

[51] Int. Cl.[5] ..... B65H 1/26

[52] U.S. Cl. ..... 221/53; 221/48; 221/55; 221/191

[58] Field of Search ..... 221/45, 46, 47, 48, 221/53, 55, 75, 191

[56] References Cited

U.S. PATENT DOCUMENTS

| | | | |
|---|---|---|---|
| 1,413,656 | 4/1922 | Dunn | 221/53 |
| 1,632,446 | 6/1927 | Krueger | 221/53 |
| 2,098,477 | 11/1937 | Welsh | 221/53 X |
| 2,143,614 | 1/1939 | Winter et al. | 221/53 |
| 2,195,437 | 4/1940 | West | 221/48 |
| 4,877,154 | 10/1989 | Matsui | 221/48 |

FOREIGN PATENT DOCUMENTS 733723 7/1955 United Kingdom .

*Primary Examiner*—Robert P. Olszewski
*Assistant Examiner*—Dean A. Reichard
*Attorney, Agent, or Firm*—Larson and Taylor

[57] ABSTRACT

A dispenser for dispensing folded, interleaved towels. The dispenser has front and back walls joined by side walls and a bottom wall with a central paper towel dispensing slot therein extending between the side walls. The dispenser has supports on the inner surfaces of the front and back walls for partially supporting sub-stacks of a stack of paper towels carried in the dispenser. The supports reduce the weight of towels carried by the bottom sub-stack of towels making it easier to dispense the towels. The dispenser also has support surfaces at the bottom for supporting the bottom towel by narrow portions adjacent its front and back sides making it easier to dispense one towel at a time.

12 Claims, 4 Drawing Sheets

DISPENSER FOR FOLDED PAPER TOWELS

This invention is directed toward a paper towel dispenser.

The invention is more particularly directed toward a paper towel dispenser of the type dispensing one paper towel at a time from a stack of interleaved paper towels.

Known paper towel dispensers have disadvantages. As the known dispensers are being used it is not uncommon for a clump of towels to be pulled out of the dispenser instead of a single towel particularly when the dispenser is relatively full. This is due to the weight of the towels in the stack creating a considerable friction force as the bottom towel is being pulled out. The increased friction force causes the bottom part of the interleaved stack of towels to be pulled sideways and for a clump of the bottommost towels to be pulled and dropped out of the dispenser outlet opening along with the bottom towel being dispensed. The extra towels that drop out are of course not normally needed at that time and usually end up as waste.

A further disadvantage of known towel dispensers is that the number of towels that can be stacked in the dispenser is quite limited. The weight of the towels in the stack presses on the bottom towels and as the height of the stack is increased, the weight and thus the friction on the bottom towel is such that the bottom towel can not be removed without tearing.

Another disadvantage of known dispensers is that when only a few towels, less than about twenty, are left in the stack, the few remaining towels can easily be tilted as a group when the bottom towel is dispensed because of the friction between the towels due to interleaving. Even though the friction force is light since there is no stack weight, there is still sufficient friction force due to interleaving to tilt the small remaining group of towels so that they slide out of the dispensing slot along with the towel being dispensed.

A still further disadvantage of known dispensers is that when a person with wet hands attempts to pull a towel from the dispenser, the pressure on the bottom towel created by the weight of the stack of towels in the dispenser may be such that the bottom towel can not be removed but will simply disintegrate and break up in the users hands.

It is the purpose of the present invention to provide a paper towel dispenser that eliminates, or at least minimizes, the above disadvantages. In accordance with the present invention there is provided a dispenser having means which reduces the weight of the stack applied on the bottom towels. With the weight on the bottom towels thus reduced, there is less friction present when the bottom towel is dispensed and it is therefore less likely that a bottom clump of towels will be pulled out with the bottom towel. The means which reduce the weight applied on the bottom towels comprise support means extending inwardly from the front and back walls of the casing above the outlet opening. Each support means partially supports two adjacent sub-stacks of towels by one side of the towels so as to relieve the weight applied by these sub-stacks on the sub-stack below. The upper of the two adjacent sub-stacks is supported by the other side of the towels by the next higher support on the opposite wall along with the next higher sub-stack. The paper towels move down from one sub-stack to the next as the towels are dispensed. In addition, by reducing the weight on the bottom towels in the dispenser it is possible to increase the number of towels and thus the height of the stack of towels in the dispenser without encountering difficulties with removing the bottom towel. This is particularly true when the users hands are wet.

Also in accordance with the present invention, there is provided a dispenser having means which reduces the friction on the towels being dispensed so as to prevent, or at least minimize the remaining towels in the dispenser from being dispensed as a group. This is particularly true when only a small group is left. The friction reducing means preferably comprises a series of steps in the bottom wall of the dispenser leading from both the front and back walls of the dispenser to the outlet opening. The steps provide a series of narrow support surfaces on which the lower most towels rest adjacent their folded edges. Since the towels only rest on their outer portions, there is less friction present when the bottom towel is pulled from the other remaining towels. This allows the bottom towel to be withdrawn without tilting the remaining towels and having them drop out through the outlet slot.

The invention is particularly directed toward a paper towel dispenser having a casing defining an interior space to hold a vertical stack of folded interleaved, horizontal paper towels. The vertical stack of paper towels is adapted to be divided into sub-stacks. The casing has front and back walls, side walls joining the front and back walls, and a bottom wall closing the bottom of the casing with a central paper towel dispensing slot in the bottom wall extending between the side walls. Towel support means are provided on the inner surfaces of the front and back walls and extending parallel to the bottom wall for partially supporting sub-stacks of the paper towels by their sides so as to reduce the weight supported by the bottom sub-stack of paper towels resting on the bottom wall.

The invention is also particularly directed toward a paper towel dispenser having a casing defining an interior space to hold a vertical stack of folded, interleaved, horizontal paper towels. The casing has front and back walls, side walls joining the front and back walls, and a bottom wall closing the bottom of the casing with a central paper towel dispensing slot in the bottom wall extending between the side walls. Narrow support surfaces are provided in the bottom of the interior space of the casing, and parallel to the bottom wall, to support the bottom towel of the stack by narrow surfaces at the front and back sides of the bottom towel so as to reduce the friction present when dispensing the bottom towel through the dispensing slot.

The invention will now be described in detail having reference to the accompanying drawings in which.

Figure 1:
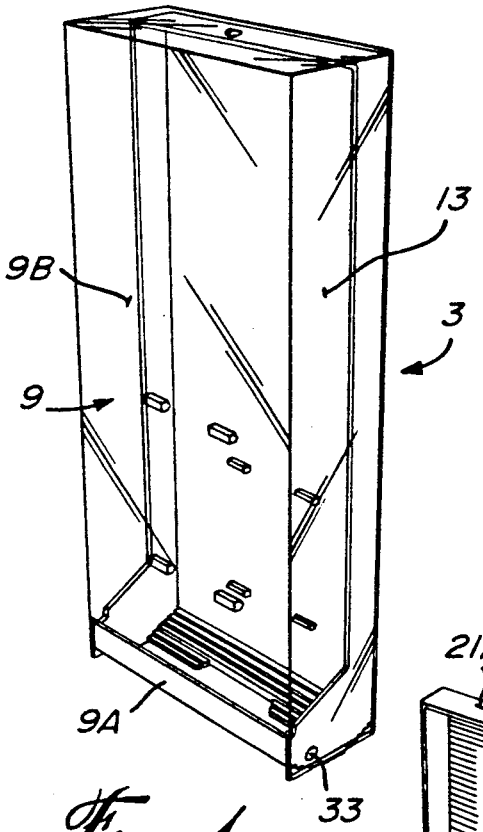
FIG. 1 is a perspective view of the dispenser in a closed position.

The paper towel dispenser of the present invention, as shown in FIGS. 1 to 4, comprises a casing 3 defining an interior space 5 for holding a stack of paper towels. The casing 3 has a front wall 9 and a back wall 11 joined by side walls 13, 15. The casing is closed at the bottom with a bottom wall 17 having a central paper towel dispensing slot 19 therein extending between the side walls 13, 15. The casing 3 also has a top wall 21. Suitable means (not shown) are provided on the back wall for mounting the casing 3 on a vertical wall in a dispensing position.

Figure 5:
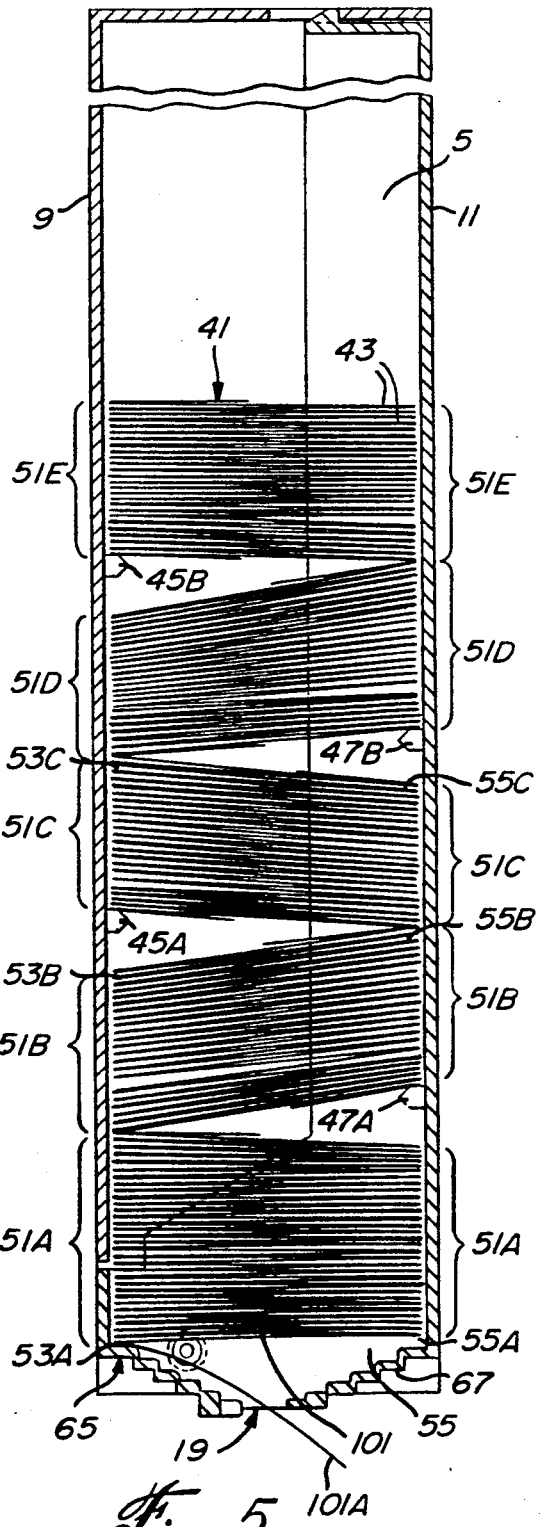
FIG. 5 is a side cross-sectional view of the dispenser with a stack of paper towels.

In a preferred embodiment of the invention, the casing 3 is made in two parts 25, 27. The back part 25 of the casing has the back wall 11, the bottom wall 17, partial side walls 13A, 15A, a partial top wall 21A, and a partial front wall 9A extending up from the bottom wall 17. The partial side walls 13A, 15A have extensions 29, 31 at the bottom making them integral with the partial front wall 9A and the bottom wall 17. The front part 27 of the casing 3 has a partial front wall 9B, the side walls 13, 15 and the top wall 21. The front part 27 of the casing 3 overlies the back part 25 of the casing and is pivotally connected to it with pivot pins 33, 35 at the sides. The pivot pins 33, 35 are located at the lower front portion of the casing 3 joining the side walls 13, 15 of the front casing part 27 to the extensions 29, 31 of the back casing part 25. In the closed position, the side walls 13, 15 on the front casing part 27 overlie the partial side walls 13A, 15A on the back casing part 25 and the top wall 21 overlies the partial top wall 21A on the back casing part 25. The partial front wall 9B of the front casing part 9 forms an extension of the partial front wall 9A on the back casing part. Cooperating latch means 37, 39 on the top wall 21 and partial top wall 21A hold the front casing part 27 to the rear casing part 25 in the closed position. Releasing the latch means 37, 39 allows the front casing part 27 to pivot away from the rear casing part 25 about pivot pins 33, 35 to open the casing and allow its interior space 5 to be substantially filled with a stack 41 of paper towels 43 as shown in FIG. 5. The front part 27 of the casing 3 can be made from transparent material so that the quantity of towels in the casing can be readily determined.

Figure 4:
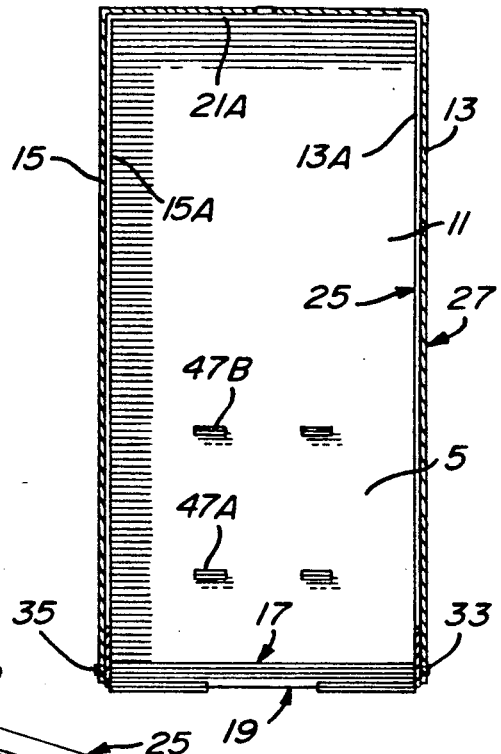
FIG. 4 is a front cross-sectional view of the dispenser taken along line 4—4 in FIG. 3.
Figure 2:
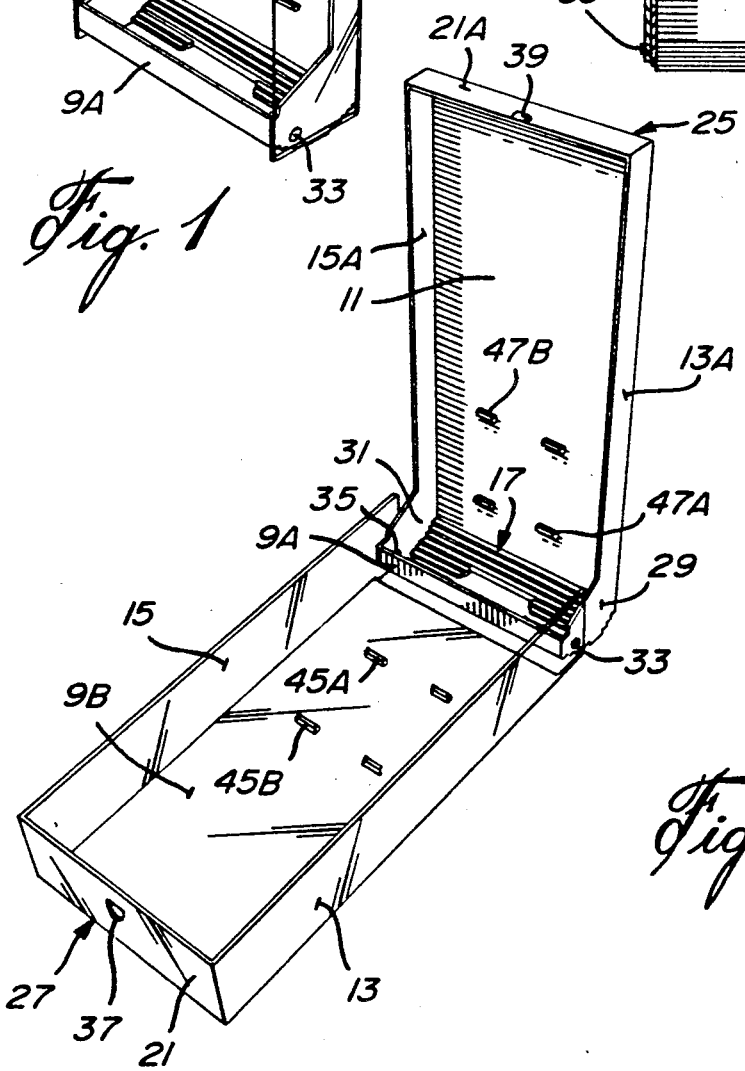
FIG. 2 is a perspective view of the dispenser in an open position.
Figure 3:
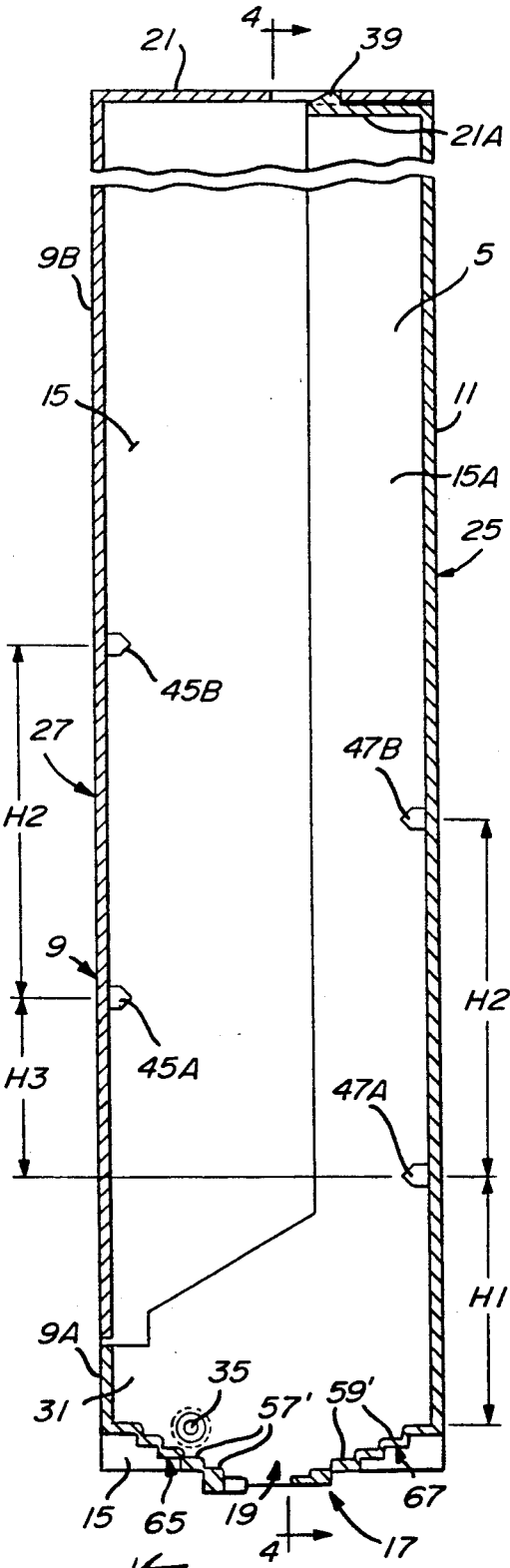
FIG. 3 is a side cross-sectional view of the dispenser when empty.

In accordance with the present invention, the casing 3 is provided with towel support means for partially supporting sub-stacks of the paper towels 43 in the casing, the sub-stacks extending up from the bottom of the casing. The towel support means as shown in FIGS. 3 and 4 comprise at least one and preferably two projections 45, 47 on each of the front and back walls 9, 11 respectively. The projections 45, 47 extend inwardly from the inner surfaces of the front and back walls 9, 11 respectively into the interior space 5 and are parallel to the bottom wall 17. Each projection 45, 47 preferably has a generally rectangular cross-sectional shape with a pointed free side to assist in penetrating the stack of towels when the front wall 9 is first closed. Other cross-sectional shapes such as cones can be used. The projections 45, 47 can extend continuously in rib form across a major portion of the front and back walls but preferably they are made discontinuous to form sets of projecting tabs.

The first projection 47A on the back wall 11 is spaced a short distance H1 above the bottom wall 17 equal to the height of from about fifty to about one hundred paper towels. The second projection 47B on the back wall 11 is spaced a distance H2 above the first projection 47A equal to about the width of a paper towel. The first projection 45A on the front wall 9 is spaced a distance H3 above the first projection 47A on the back wall 11 equal to about one half the width of a paper towel. The second projection 45B on the front wall 9 is spaced a distance H2 above the first projection 45A on the front wall 9 equal to about the width of a paper towel. It will be seen that the projections 45, 47 alternate with each other in their location above the bottom wall 17.

Each projection 45, 47 as shown in FIG. 5, partially supports two sub-stacks 51 of paper towels 43 so as to relieve the bottommost sub-stack 51A of towels adjacent the outlet opening 19 from the weight of the rest of the stack of towels. The towels in the bottom sub-stack 51A rest on the bottom wall 17 of the casing. The first projection 47A on the back wall 11 partially supports the second sub-stack 51B adjacent the back side 55B of the towels in this sub-stack and also supports the third sub-stack 51C along the back side 55C of its towels. The back sides 55 of the towels in sub-stacks 51B, 51C are spaced above the towels in the bottom sub-stack 51A thus relieving the weight of the towels in these sub-stacks from the bottom sub-stack 51A. The front side 53B of the towels in sub-stack 51B rests on the sub-stack 51A. The front side 53C of the towels in sub-stack 51C rests on the first projection 45A on the front wall 9 above the sub-stacks 51A, 51B. Similarly, the sub-stack 51D is supported by projection 47B and sub-stack 51E is supported by projection 45B. Thus it is seen that very little of the weight of the stack is borne by the bottom sub-stack 51A. Since there is little weight on the bottom sub-stack 51A clumps of paper towels in this sub-stack do not tend to be pulled over on their side as readily when the towels are being pulled out, and thus the inadvertent dispensing of a clump of towels is minimized.

In addition, since there is little weight on the bottom sub-stack 51A the number of towels and the height of the stack of towels in the dispenser have little effect on the dispensing of the bottom towel from the dispenser. It is thus possible to increase the number of towels in the dispenser over that in known dispensers. Also, the possibility of the towels disintegrating and breaking up when the users hands are wet is greatly reduced.

As the towels are dispensed they move down singly or in small groups from one sub-stack to the next. The size of the projections and their vertical spacing relative to each other is arranged to allow the bottommost towel or towels in each sub-stack to slide off the projection that is supporting it or them and drop down onto the next sub-stack without causing the towels to tilt in clumps to a vertical position and/or without causing them to lose their interleaving.

The casing 3 is also provided with means to improve the overall operation of the dispenser and to ensure that the last few towels in the casing are individually dispensed. Often the remaining towels in the last sub-stack are pulled sideways on drawing a single towel off the sub-stack and these towels fall out in a clump through the dispensing slot.

In accordance with the present invention the bottom of the interior space 5 of the casing is provided with narrow towel support surfaces for supporting the bottom towel so that it can be more easily withdrawn from the stack. The support surfaces are parallel with the bottom wall of the casing and there is at least one support surface on each side of the dispensing slot extending between the side walls of the dispenser. A support surface on each side of the slot supports the bottom towel of the stack by narrow surfaces at the front and back sides of the bottom towel thereby reducing the friction present when dispensing the bottom towel through the dispensing slot.

Figure 6:
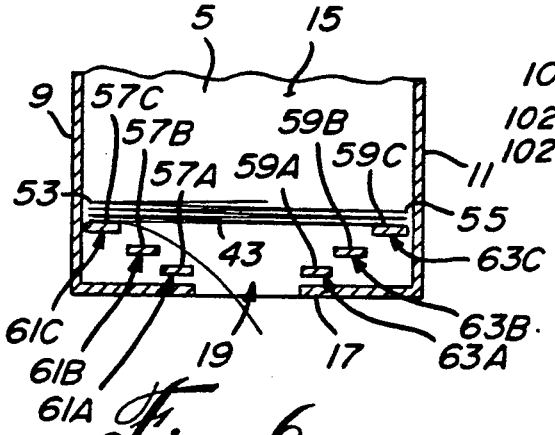
FIG. 6 is a partial cross-sectional view of the bottom of the dispenser showing one embodiment of the support surfaces supporting the bottom towel.

As shown in FIG. 6, the support surfaces 57, 59 on each side of the dispensing slot 19, can comprise the upper surface of strips 61, 63 of material extending across the bottom of the interior space 5 just above the bottom wall 17. One strip 61, 63 can be provided on each side of the slot 19 but preferably, a plurality of strips 61A, 61B etc, and 63A, 63B etc. is provided on each side of the slot 19. The strips 61A, 63A closest to the slot 19 are the lowest. Each succeeding strip, on each side of the slot, in a direction away from the slot is slightly higher than the preceding strip. Thus strips 61B, 63B are slightly higher than strips 61A, 63A and strips 61C, 63C are slightly higher than strips 61B, 63B. The arrangement of the stepped strips 61, 63 permits the bottom towel to always have some support adjacent its front and back sides as it is pulled out of the dispensing slot while still minimizing friction on the towel. The front and back sides 53, 55 of the bottom towel 43 slide down from one strip to the next as the towel is being pulled out.

In a preferred embodiment of the invention, as shown in FIG. 3, the surfaces 57', 59' can be provided by forming two sets of steps 65, 67 in the bottom wall 17 of the casing with each set of steps 65, 67 leading down toward the dispensing slot 19 from the respective front wall 9 and back wall 11 where the steps begin. The tread of each step 65 forms a support surface 57' and the tread of each step 67 forms a support surface 59'. The stepped support surfaces 57', 59' provide support for the bottom towel adjacent its front and back sides as it is being dispensed.

Figure 7:
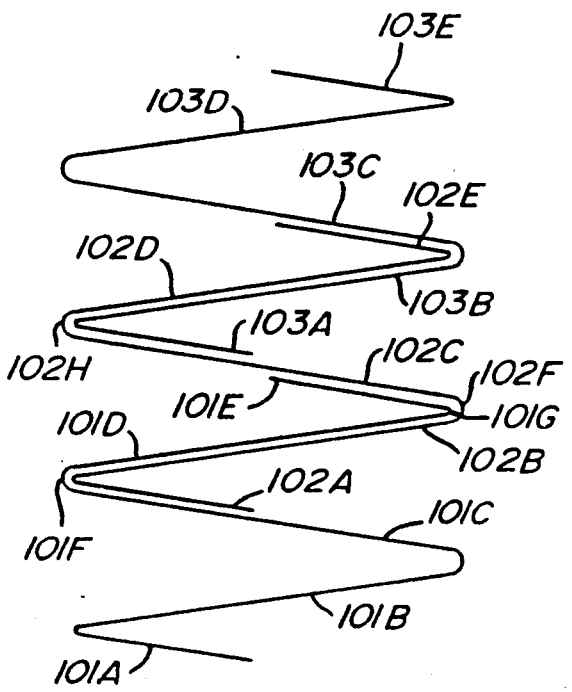
FIG. 7 is a diagram illustrating the interleaving and overlapping of one type of folded paper towel.
Figure 8:
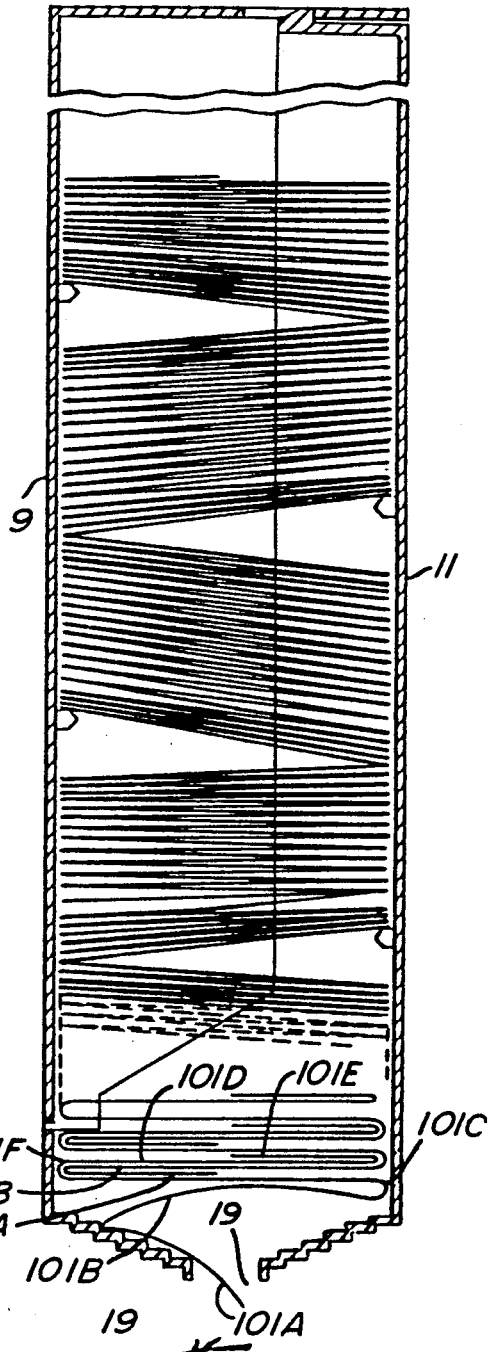
FIG. 8 is a diagram illustrating the initial placement of the folded paper towels after being inserted in the dispenser.
Figure 9:
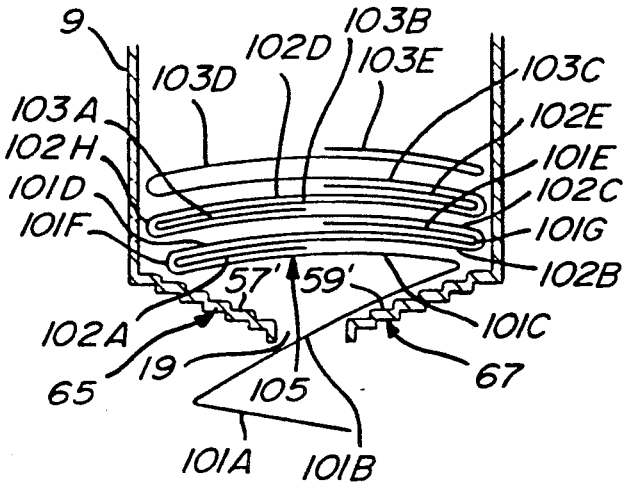
FIG. 9 is a diagram illustrating the movement of the paper towels as the bottom towel is pulled to commence removal.
Figure 10:
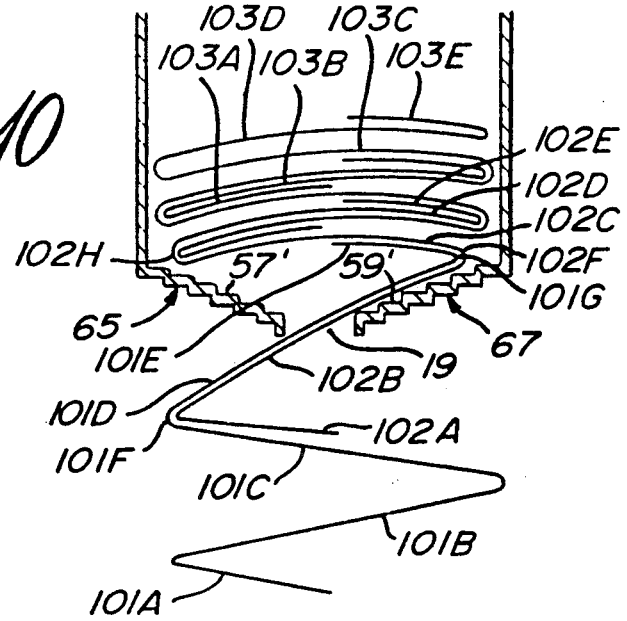
FIG. 10 is a diagram illustrating the movement of the paper towels as the bottom towel is removed from the dispenser.

FIG. 7 illustrates diagrammatically the folding and interleaving of the paper towels. When the folded paper towels are first placed in the dispenser, they take up a configuration similar to that shown in FIG. 8, with the bottom fold 101A of the bottom towel 101 being close to the outlet 19. When the bottom fold 101A is pulled to remove bottom towel 101 from the dispenser as is illustrated in FIG. 9, folds 101B and 101C are pulled towards the outlet 19 and this causes the edge 101F of the towel 101 adjacent to the front wall 9 to move inwardly and the edge 101F is moved down one or more of the steps 65 towards the outlet 19. As the towel 101 is pulled further out of the dispenser, folds 101D and 101E are moved causing edge 101G to move downwardly towards the outlet 19. As will be seen from FIG. 10 this moves the edge 101G down one or more of the steps 67. Towel folds 101D and 101E are in close surface to surface contact with folds 102B and 102C of towel 102. Thus, the movement of edge 101G results in a similar movement in edge 102F of towel 102 causing edge 102F to be brought down the steps 67 and bottom fold 102A is moved so as to protrude from dispensing slot 19.

When it is desired to remove the second towel 102 the first fold 102A is pulled, folds 102B, 102C and 102D are moved, causing edge 102H of towel 102 to descend the steps 65. As additional towels are pulled from the dispenser the edges of the towels close to the outlet 19 adjacent the front wall 9 and the back wall 11 are moved inwardly and pulled down the steps 65 and 67 resulting in the bottom stack of towels 51A being supported on two quite narrow strips where it contacts the steps 65 and 67. Thus the bottom towel 101 can be more easily pulled out of the dispenser since less friction is encountered. This reduces the tendency of the few remaining towels to drop out as a group when the bottom towel is being dispensed.

I claim:

1. A paper towel dispenser having a casing defining an interior space to hold a vertical stack of folded, interleaved, horizontal paper towels; the vertical stack adapted to be divided into sub-stacks; the casing having front and back walls, side walls joining the front and back walls, and a bottom wall closing the bottom of the casing with a central paper towel dispensing slot in the bottom wall extending between the side walls; and towel support means on the inner surfaces of the front and back walls and extending parallel to the bottom wall, for partially supporting sub-stacks of the paper towels by their sides so as to reduce the weight supported by the bottom sub-stack of paper towels resting on the bottom wall, the towel support means on both walls being staggered in height from the bottom wall.

2. A paper towel dispenser as claimed in claim 1 wherein each support means comprises a rib extending continuously across a major portion of the front or back wall.

3. A paper towel dispenser as claimed in claim 1 wherein there are at least two towel support means on one of the front and back walls, the towel support means on the one wall vertically spaced-apart a distance sufficient to allow the lower support means to support two sub-stacks of towels by one side.

4. A paper towel dispenser as claimed in claim 1 wherein each support means comprises a set of tabs arranged in a line and extending across the front or back wall.

5. A paper towel dispenser as claimed in claim 1 wherein there are at least two towel support means on each of the front and back walls, the towel support means on each wall vertically spaced-apart a distance sufficient to allow the lower support means to support two sub-stacks of towels by one side.

6. A paper towel dispenser as claimed in claim 5 wherein the support means closest to the bottom wall is located a distance equal to the height of from about fifty to one hundred paper towels above the bottom wall.

7. A paper towel dispenser as claimed in claim 6 wherein each succeeding higher support means is located a distance equal to about one half the width of a folded paper towel above the preceding support means.

8. A paper towel dispenser as claimed in claim 1 having two towel support means, one of the support means being on one of the front and back walls above the bottom wall, the other support means being on the other of the front and back walls and located a distance equal to about one half the width of a folded paper towel above the one support means.

9. A paper towel dispenser as claimed in claim 8 wherein the one support means is located a distance equal to the height of from about fifty to one hundred paper towels above the bottom wall.

10. A paper towel dispenser as claimed in claim 9 including one or more additional support means projecting a short distance into the interior space of the casing, each additional support means located on the opposite wall to the wall containing the last highest support means and located a distance above the last highest support means equal to about one half the width of a folded paper towel.

11. A paper towel dispenser as claimed in claim 10 wherein there is a plurality of support surfaces on each side of the dispensing slot extending between the side walls of the casing, the support surface closest to the slot on each side being the lowest surface, each succeeding support surface on each side of the slot in a direction away from the slot being slightly higher than the preceding support surface; the support surfaces arranged to continuously support the bottom towel of the stack by narrow surfaces at its front and back sides so as to reduce the friction present when dispensing the bottom towel through the dispensing slot.

12. A paper towel dispenser as claimed in claim 11 wherein the support surfaces on each side of the slot are the treads of a set of steps formed in the bottom wall of the casing.

* * * * *